United States Patent [19]

Nagasawa

[11] Patent Number: 4,669,942

[45] Date of Patent: Jun. 2, 1987

[54] DEVICE FOR SUPPLYING PACKAGES TO WARPER CREELS

[75] Inventor: Isao Nagasawa, Kusatsu, Japan

[73] Assignee: Murata Kikai Kabushiki Kaisha, Kyoto, Japan

[21] Appl. No.: 793,679

[22] Filed: Oct. 31, 1985

[30] Foreign Application Priority Data

Nov. 2, 1984 [JP] Japan ..... 59-231987

[51] Int. Cl.[4] ..... B65G 47/04

[52] U.S. Cl. ..... 414/331; 198/487.1; 198/803.12; 242/35.5 A; 414/347; 414/352; 414/395; 414/398; 414/400; 414/509; 414/908; 414/564

[58] Field of Search ..... 198/487.1, 803.12, 372, 198/436, 468.6; 242/35.5 A; 414/908, 910, 331, 345, 347, 349, 351, 352, 353, 395, 390, 398, 400, 509, 517, 280, 281, 277, 276, 269, 564

[56] References Cited

U.S. PATENT DOCUMENTS

| | | | |
|---|---|---|---|
| 2,985,982 | 5/1961 | Smith | 414/345 X |
| 3,314,544 | 4/1967 | Cuniberti | 198/436 X |
| 3,924,762 | 12/1975 | Igel | 414/331 |
| 4,088,226 | 5/1978 | Vlcek | 198/487.1 X |
| 4,138,072 | 2/1979 | Aoyama et al. | 242/35.5 A |
| 4,153,211 | 5/1979 | Lenk et al. | 242/35.5 A |
| 4,555,215 | 11/1985 | Raasch et al. | 414/398 X |
| 4,565,278 | 1/1986 | Asai et al. | 242/35.5 A |

FOREIGN PATENT DOCUMENTS

| | | | |
|---|---|---|---|
| 1390177 | 1/1965 | France | 198/434 |
| 124920 | 5/1949 | Sweden | 414/281 |
| 2152084 | 7/1985 | United Kingdom | 242/35.5 A |

*Primary Examiner*—Leslie J. Paperner
*Assistant Examiner*—Stuart J. Millman
*Attorney, Agent, or Firm*—Barnes, Kisselle, Raisch, Choate, Whittemore & Hulbert

[57] ABSTRACT

The present invention resides in a device comprising a package stock truck moved in the row direction of warper creels, a package feeding conveyor for feeding yarn supply packages to the position of the stock truck, a first package transfer mechanism for transferring the packages on the package feeding conveyor onto the stock truck, and a second package transfer mechanism for transferring the packages on the stock truck to each of pegs of the warper creels.

10 Claims, 28 Drawing Figures

P8
S7
58
P5
P4
P3
P2
61
60
59
P7
P6
P1
S10
62i
62h
62g
62f
62a
A
1/2

DEVICE FOR SUPPLYING PACKAGES TO WARPER CREELS

Field of the Invention and Related Art Statement

The present invention relates to a device for supplying packages to warper creels in a warping machine.

In a warping machine used in a warp preparation process for a weaving machine, yarns drawn out from a multiplicity of yarn supply packages fitted to warper creels are taken up around a warper drum. Therefore, an extremely large number of the yarn supply packages corresponding to the number of warps for the weaving machine are supported by the warper creels on vertical planes at such intervals that the yarns being drawn out do not interfere with each other; for instance, a thousand and several hundreds of packages are orderly supported by the pegs of the creels.

Hitherto, the supply of the packages to the creels has been performed manually by the worker, by one package at a time.

Where the packages have been supplied by the worker as mentioned above, it has been necessary to use a truck for supplying the package to the uppermost creel (in the case of a certain large number of stages of the creels) or to move between a package storage area and the creels a number of times. In addition, since each package has a large weight of a few kilograms, workability has been bad, and much operating time and a large number of workers have been required for the work. Further, there has been the disadvantage of staining of the yarn layers on the packages by the worker, causing a lowering in the yarn quality.

OBJECT AND SUMMARY OF THE INVENTION

An object of the present invention is to propose an apparatus in which a large number of yarn packages may efficiently and quickly be supplied on pegs of warper creels in a warping machine.

The present invention resides in a device comprising a package stock truck moved in the row direction of warper creels, a package feeding conveyor for transporting packages to the position of the stock truck, a first package transfer mechanism for transferring the packages on the package feeding conveyor onto the stock truck, and a second package transfer mechanism for transferring the packages on the stock truck to each of pegs of the warper creels.

The packages fed on the package feeding conveyor are momentarily transferred to the pegs on the stock truck by the first package transfer mechanism provided on the truck. For instance, the packages for a row of creels are transferred to the stock truck, and then the plurality of packages are simultaneously transferred to the pegs of the row of creels by the second transfer mechanism provided on the truck.

DETAILED DESCRIPTION OF PREFERRED EMBODIMENTS

Figure 1:
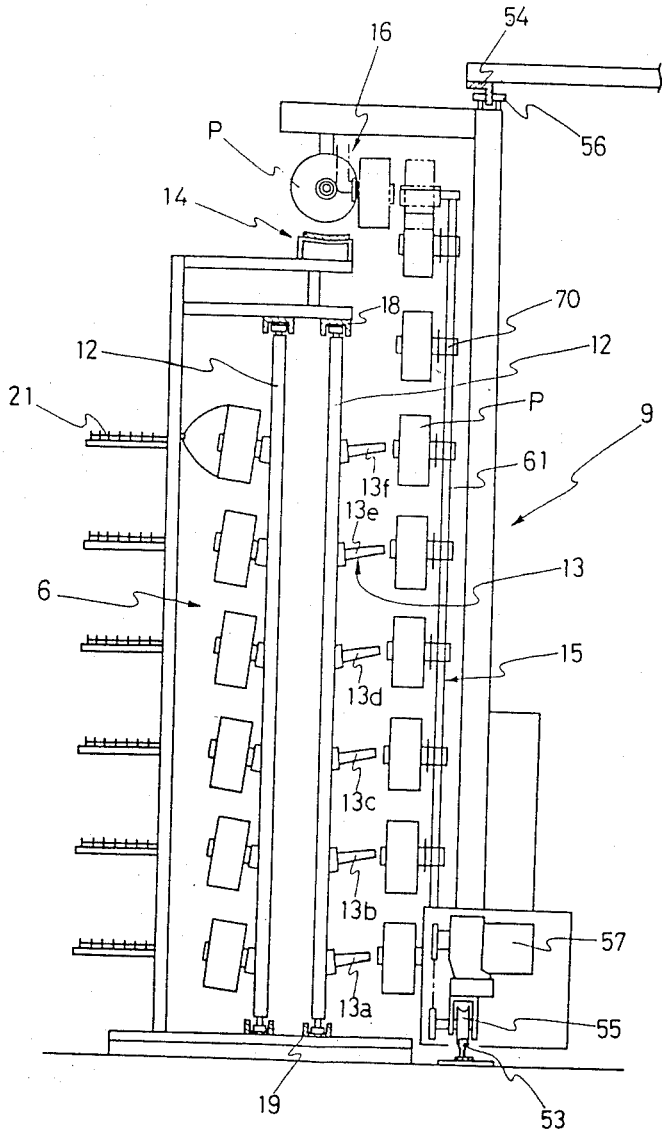
FIG. 1 is a side view showing a general constitution of an embodiment of the device according to the invention.

An embodiment of the device according to the present invention will be described below by referring to the drawings.

Figure 3:
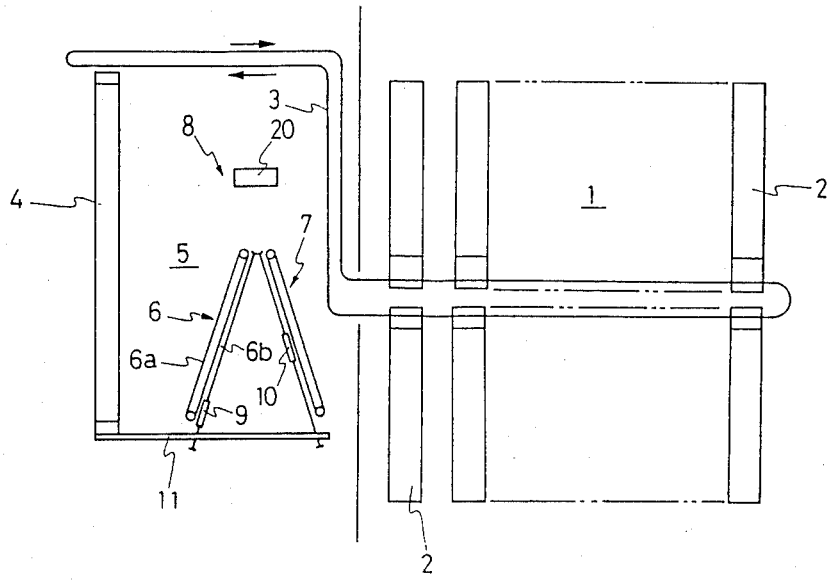
FIG. 3 is a layout plan showing an example of relative positions of a production process of yarn supply packages, a package storage area and a warping process.

In FIG. 3, there is shown an example of layout of a package feeding system.

Area 1 shows a rewinding step for rewinding a spinning bobbin from a ring-spinning frame into a predetermined amount of package, or a spinning step in which a large package is obtained directly by pneumatic spinning such as open-end, false twist spinning. For instance, a multiplicity of fine spinning frames 2 are provided in parallel, and doffed packages are suspended by hook hangers moved along a rail on the ceiling and are fed along a feed passage 3 to a package storage area 4.

Area 5 is a warp preparation area for a weaving machine, where warper creels 6, 7 and a warping machine 8 are provided. The creels 6, 7 are disposed in a roughly V-shaped configuration, and a multiplicity of package support pegs are orderly arranged in plural stages and plural rows. Numerals 9 and 10 denote package stock trucks which are movable along the creels for receiving the packages fed on a conveyor 11 from the package storage area 4 and supplying them to the pegs at predetermined positions. Although the following description will be made as to the warper creels 6 and the stock truck 9 on one side, the same description applies also to the warper creels and the truck on the other side.

Figure 2:
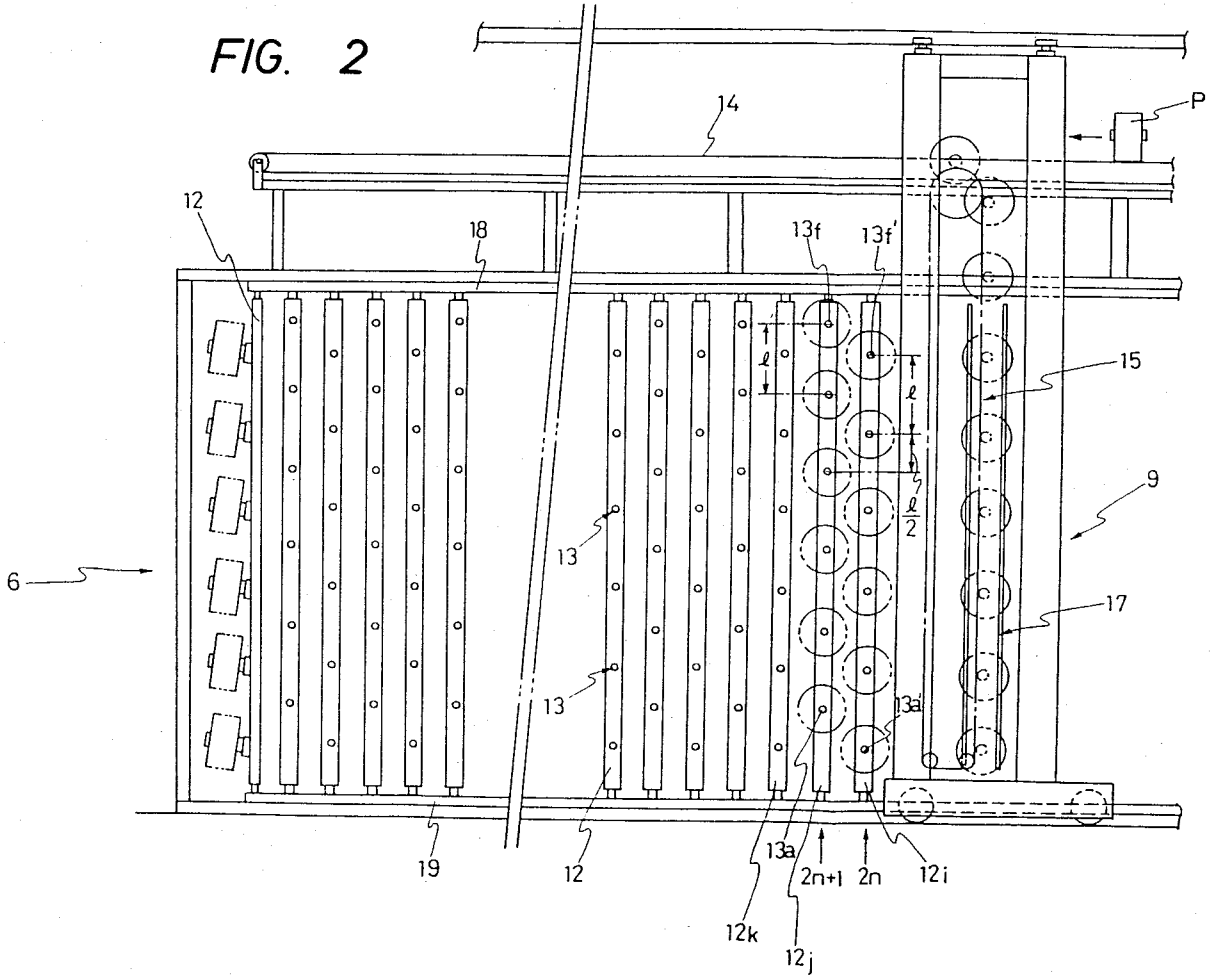
FIG. 2 is a rear view showing the positional relationship of packages between warper creels and a stock truck.

In FIGS. 1 and 2, the creels 6 are of the circulatory type, and the pegs 13 on each support frame 12 are disposed in a staggered manner, with 6 pegs in a row, in the example shown.

Alternatively, the creels may be of the fixed type in which only the pegs are swiveled, may be of the type in which each plurality of rows can be rotated as a group together with the frame, or may be of the type in which adjacent pegs on each frame are at the same level, etc.

Above the creels 6 is provided a package feeding conveyor 14 extending along the row of the creels. Further, a stock truck 9 is provided which is movable along the conveyor 14 and in the row direction of the inside ones of the creels 6. The stock truck 9 is provided with a first package transfer mechanism 16 for transferring the packages P on the conveyor 14 to a stock part 15 provided on the truck 9, and a second package transfer mechanism 17 for transferring the packages to the pegs of the creels at predetermined positions after a predetermined number of packages are transferred to the stock part 15.

Each of the abovementioned devices will be described in detail below.

(i) Creel device

In FIGS. 1 to 3, a multiplicity of movable peg support frames 12 are connected along upper and lower annular rails 18, 19 at regular pitch in the row direction. The peg support frames are fixed to, for instance, chains at regular pitch, and are circulatorily moved by a drive source (not shown). Pegs 13*a* to 13*f* for supporting packages are fixed to each of the peg support frames 12 at regular pitch in the vertical direction in the manner of projecting from the surface of the frame. The pegs on the adjacent support frames are disposed in a staggered manner so that spaces in the row direction are effectively utilized. Accordingly, as shown in FIG. 2, the vertical positions of the pegs on an even-numbered $2n$ (wherein $n=0, 1, 2, 3, \ldots$) support frame 12*i* are staggered from those of the pegs on an odd-numbered $2n+1$ support frame 12*j* by a distance equal to $\frac{1}{2}$ of the pitch l of the pegs. The vertical pitch l of the pegs is the same for all of the support frames 12*i*, 12*j*.

Such support frames are connected in an endless form as shown in FIG. 3. The creels on the side on which the yarns drawn out from the packages on the pegs are moved to a warper drum 20 are referred to outside creels 6*a*, while the creels on the side on which the package stock truck 9 is moved are referred to inside creels 6*b*. Namely, when the yarn supply packages are already fitted to all the outside creels 6*a* and a warping operation is conducted, a blank bobbin on the peg of the inside creel 6*a* is replaced by a new yarn supply package. Numeral 21 denotes a yarn guide.

(ii) Package feeding conveyor

Figure 4:
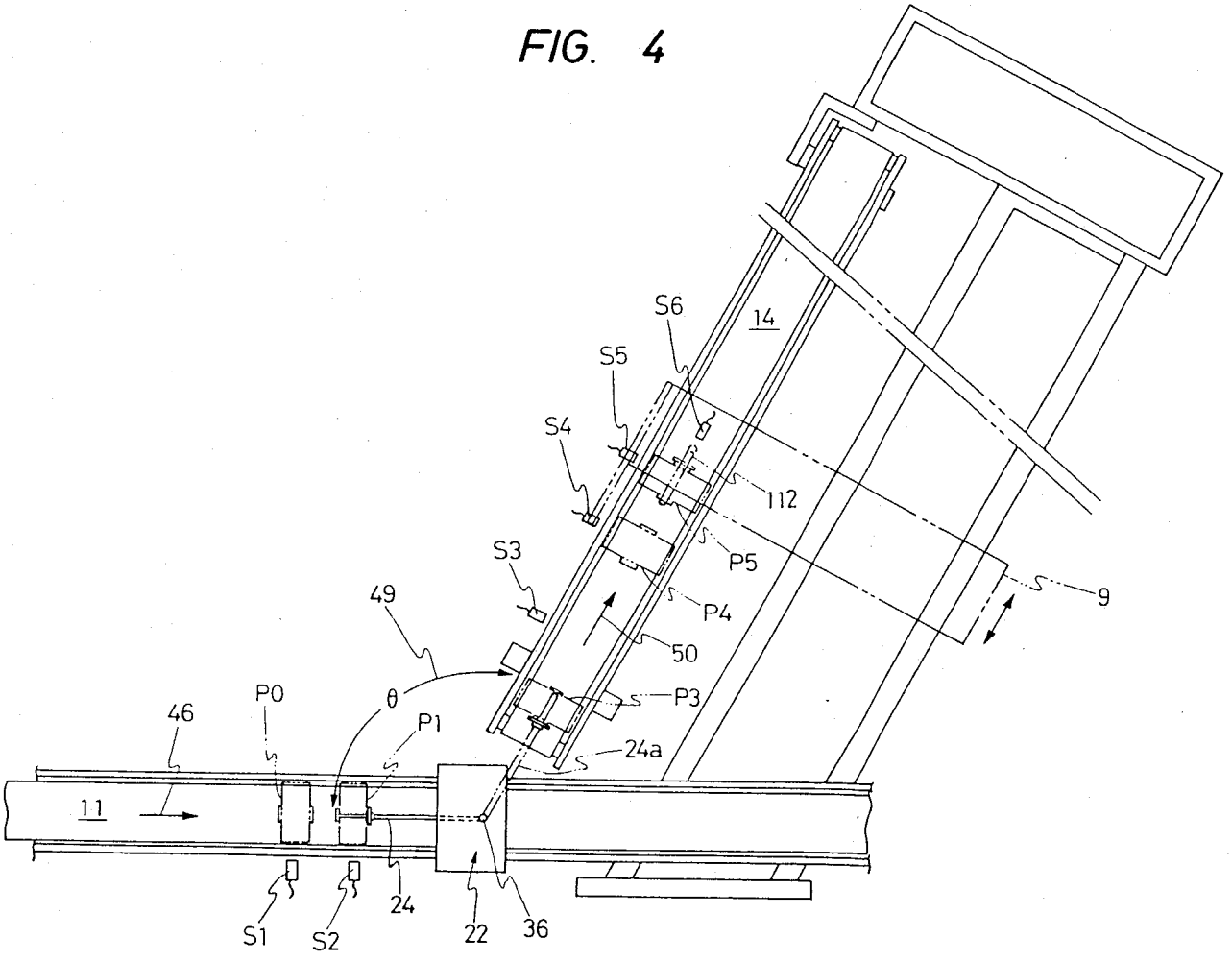
FIG. 4 shows a plan view of an embodiment of a package feeding conveyor.

In FIGS. 1, 3 and 4, the first conveyor 11 is extended from the package storage area 4 while connecting the ends of a pair of creels 6, 7, and the second conveyor 14 intersecting the conveyor 11 at an angle is provided above the creels 6 along the row direction of the creels, as shown in FIGS. 1 and 4. Although FIG. 4 shows only the conveyor 14 provided above the creels 6, a similar conveyor intersecting the conveyor 11 at another angle is provided above the creels 7 on the other side. Depending on the location of the package storage area, the first conveyor and the second conveyor may be provided as one body.

Since in the present embodiment the first and second conveyors 11, 14 are separate from each other, a package direction converter 22 is provided between the conveyors.

Namely, in FIGS. 4 to 7, the first conveyor 11 and the second conveyor 14 are so provided that their package feeding surfaces are substantially flush with each other, and the package direction converter 22 is provided on a frame 23 of the first conveyor 11. The direction converter 22 is constituted of a package holding hook 24 moved vertically and swiveled through a fixed angle and a driving part 25 for the hook 24.

Figure 7:
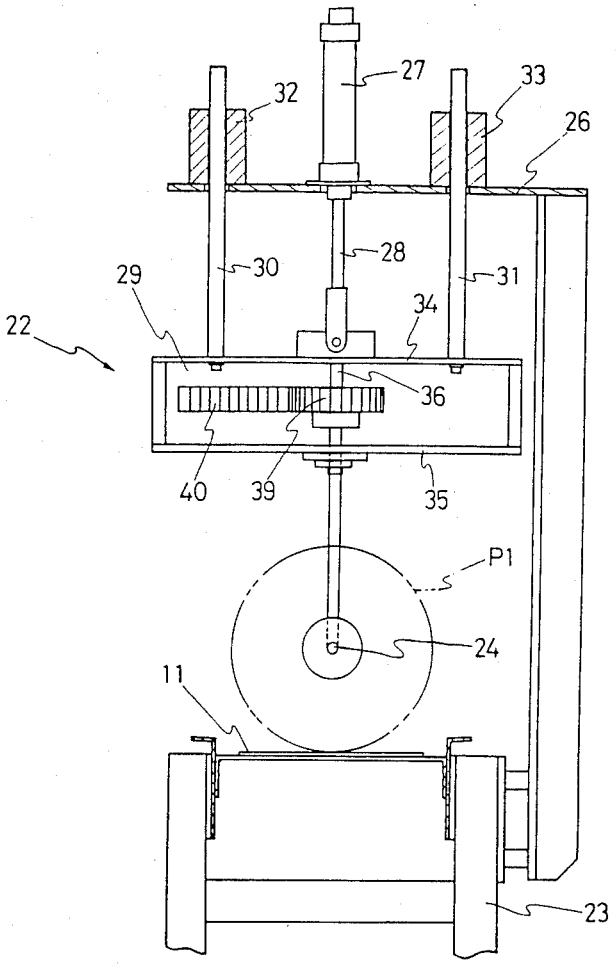
FIG. 7 shows a side view of the converter.

In FIG. 7, a piston rod 28 of a hydraulic cylinder 27 disposed vertically on a fixed frame 26 penetrates downward through the frame 26, and swiveling driving box 29 for the hook 24 is suspended from the lower end of the piston rod 28. Numerals 30, 31 denote slide shafts penetrating through slide guides 32, 33 on the frame 26 and through the frame 26 and fixed to the upper surface of the driving box 29. The slide shafts 30, 31 function as a guide for vertical movement of the driving box 29.

Figure 6:
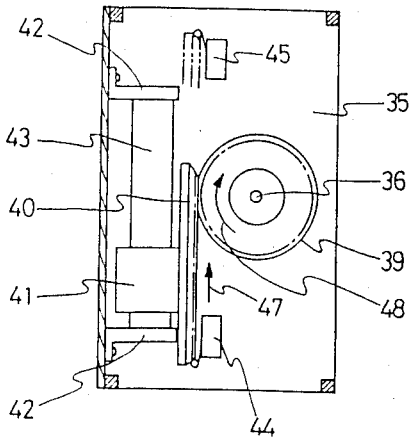
FIG. 6 shows a plan view of a hook-swiveling mechanism of the converter.

A shaft 36 supported by the upper and lower plates 34, 35 of the driving box 29 is bent at a part thereof below the lower plate 35 to form the holding hook 24. Namely, a flange part 38 having a diameter larger than the diameter of the bobbin 37 is fixed to the part corresponding approximately to the width W of the package P1 to constitute a stopper for the package. A pinion 39 is fixed to an upright shaft part 36 of the hook 24, and a rack 40 provided with teeth engaging with the pinion is fixed to a cylinder 42 of a rodless cylinder, as shown in FIG. 6. Namely, a piston rod 43 is fixed between brackets 42, 42 fixed to the driving box 29, and the cylinder 41 side is reciprocated along the rod 43; by the movement of the rack 40 fixed to the cylinder 41, the shaft 36 is rotated and the package holding hook 24 is swiveled in a fixed angle range with the shaft 36 part as a center. The swiveling angle is equal to the angle of intersection $\theta$ of the first and second conveyers 11, 14, and is determined by micro-switches 44, 45 provided at two positions in FIG. 6.

Figure 5:
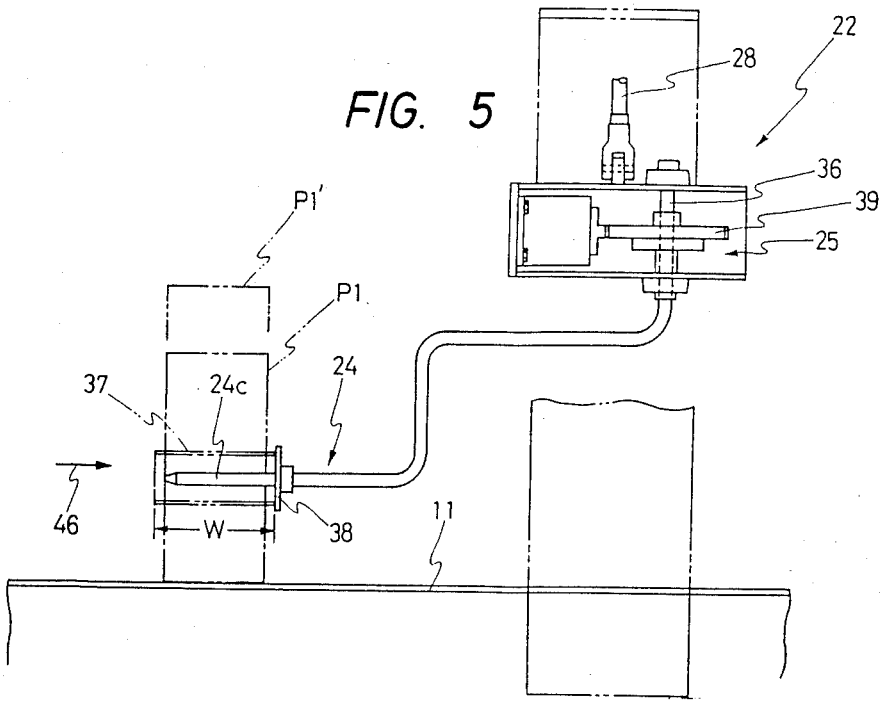
FIG. 5 shows a front view of an example of a package direction converter provided between a first conveyor and a second conveyor.

Accordingly, in the condition shown in FIGS. 4 and 5 in which the hook 24 is positioned toward the upstream side of the first conveyor 11, when the package P1 is fed in the direction of arrow 46, the hook 24 is located in a center hole 37 of the package P1, the driving box 29 is moved upward by the operation of the hydraulic cylinder 27, and the package P1 is moved up to the two-dotted line position P1′ in FIG. 5 while separating from the surface of the belt 11. Thereafter, the hydraulic cylinder 41 in the driving box operates to slide the rack 40 shown in FIG. 6 in the direction of arrow 47, whereby the pinion 39 is rotated a fixed angle in the direction of arrow 48, the hook 24 is swiveled about the shaft 36 along the locus of arrow 49 in FIG. 4, and the package P1 is moved to a position above the second conveyor 14. Then, the hydraulic cylinder 27 on the frame 26 is again operated to lower the piston rod 28 shown in FIG. 5, the package P1 on the hook is placed on the second conveyor 14, the package P1 is drawn out of the hook 24 by the movement of the conveyor 14, and feeding in the direction of arrow 50 in FIG. 4 is started.

After completion of the feeding of one package from the first conveyor 11 onto the second conveyor 14, the hook 24 is returned to the position on the first conveyor 11 through the reverse operation, then the next package is fed, and these operations are repeated to intermittently and sequentially converting the feeding direction of the package.

(iii) Stock truck

Figure 8:
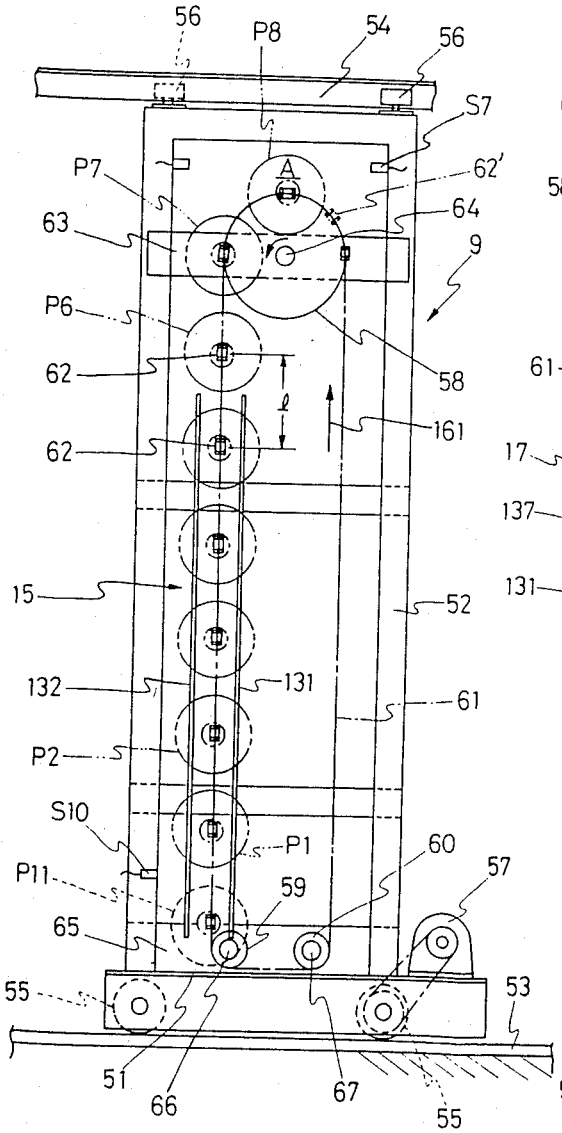
FIG. 8 is a plan view showing the relative positions of a stock part of the stock truck and a pusher.
Figure 9:
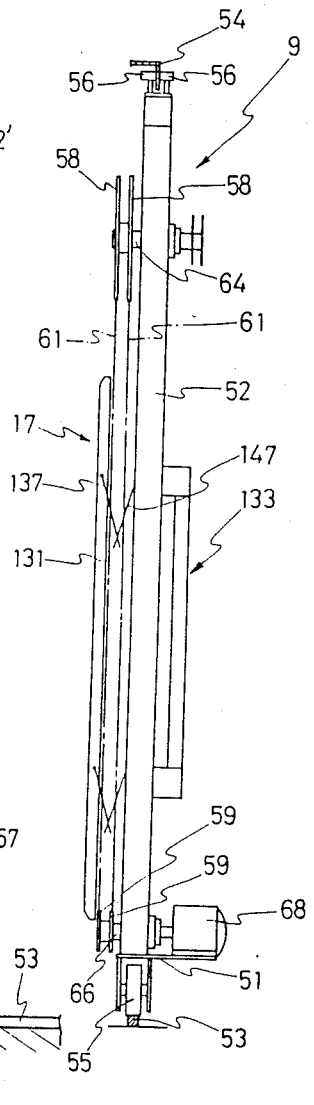
FIG. 9 is a side view of the stock truck shown in FIG. 8.

As shown in FIGS. 1, 8 and 9, the frame of the package stock truck 9 is constituted of a machine base 51 and a vertical frame body 52 provided upright on the machine base 51, and is supported on a lower rail 53 and an upper rail 54 extending in the row direction of the creels 6, through wheels 55 and guide rollers 56, so that it can be moved. Numeral 57 denotes a motor for moving the truck.

The truck 9 is provided with a package stock part 15 in which package support members 62 are fixed, at the same pitch l as that of the pegs of the creels 6, to chains 61 fitted in an endless form to upper sprockets 58 and lower sprockets 59 provided on the creel side, the first package transfer mechanism 16 for transferring the packages on the package feeding conveyor 14 provided above the creels to the support members 62 provided at the stock part, and the second package transfer mechanism 17 for transferring the one creel row amount of packages stocked at the stock part shown in FIGS. 8 and 9 to the pegs of the creels.

(iv) Package stock part

In FIGS. 8 and 9, a pair of large sprockets 58, 58 are fixed to a shaft 64 on an upper frame 63 of the truck, pairs of small sprockets 59, 59 and 60, 60 are fixed respectively to shafts 66, 67 on a lower frame 65, and a pair of endless chains 61, 61 are fitted to a pair of sprocket groups 58, 59, 60.

The shaft 66 for the sprockets 59 is driven by a motor 68, so that the chain can be fed pitch by pitch.

Figure 12:
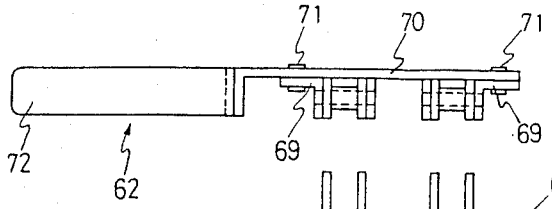
FIG. 12 is a plan view showing the same.
Figure 10:
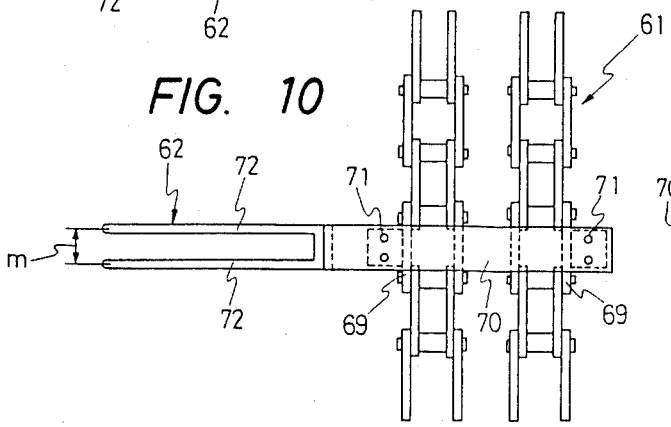
FIG. 10 is a side view showing the fitting condition of package support members to chains at the stock part.
Figure 11:
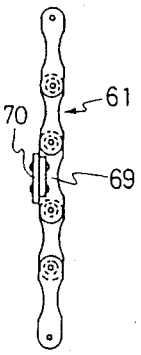
FIG. 11 is a rear view showing the same.

The package support members 62 are fixed to the chains 61, 61 at a pitch l equal to the vertical pitch l of the pegs on the creel side. Namely, in FIGS. 10 to 12, for example, roller chains 61 are used, in which link plates 69, 69 are L-shaped, a bracket 71 is fixed astride the link plates 69, 69 by screws 71, 71, and a forked package support member 62 is fixed to the bracket 70 by welding or the like.

The support member 62 is provided with two plates 72, 72 opposite to each other with a gap m therebetween so that the hook of the first package transfer mechanism described later can pass between the plates 72, 72.

Such package support members 62 are fitted to the chains 61, 61 at regular pitch.

Further, the large sprocket 58 provided at an upper part of the stock part has a diameter D which is so set that $\pi D=4l$ (wherein l is the vertical pitch of the creel pegs, and $\pi$ is the ratio of the circumference to its diameter). Namely, in FIG. 13, when the package support member 62 comes to the uppermost position A of the sprocket, the package on the upper feeding conveyor is transferred to the support member 62 at the supply position A by the first transfer mechanism, and when the sprocket 58 is rotated 90°, the next support member 62' comes to the uppermost position, namely, the package supply position A; the sprocket 58 is intermittently rotated 90° at a time.

Figure 14:
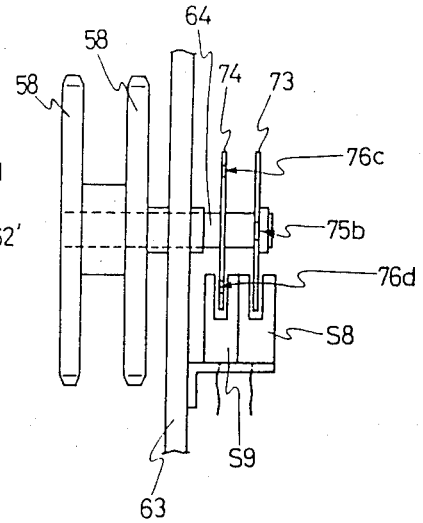
FIG. 14 is a side view of the same.

The intermittent rotation is controlled by rotational angle detecting disks 73, 74 and sensors S8, S9, shown in FIG. 14, which are fixed to the shaft 64 for the sprocket 58. Namely, one of the disks 73 is provided with notches **75*a* to 75*d* angularly spaced by 90° from each other, the sensor S8** (which may be, for instance, a light transmission type photoelectric tube sensor or a proximity sensor) is provided for detecting the notch, and the motor for driving the chains is stopped each time the notch is detected.

Further, the other disk 74 is provided with similar notches **76*a* to 76*d* at an angular interval of 90° while being phase-shifted by 45° from the notches 75*a* to 75*d* of the disk 73, and the notches 76*a* to 76*d* are detected similarly by the sensor S9**. Namely, in the present embodiment, in view of the fact that the creel pegs on a frame are vertically staggered from those on the adjacent frame by a distance equal to $\frac{1}{2}$ of the vertical pitch of the pegs, two rotational angle detecting disks with a 45° phase shift therebetween and the sensors are provided in order that the position of the package stocked on the chains coincides with the position of the creel peg for receiving the package when transferring the package from the stock truck to the creel.

Namely, when transferring a package from the feeding conveyor 14 to the stock truck, the sprockets 58 are intermittently rotated 90° at a time, and after a predetermined number of packages are transferred to the stock part, the sensor is switched to detect the 45° rotation.

(v) First package transfer mechanism

The first package transfer mechanism 16 provided at an upper part of the stock truck 9 will be explained below by referring to FIGS. 15 to 17.

Figure 15:
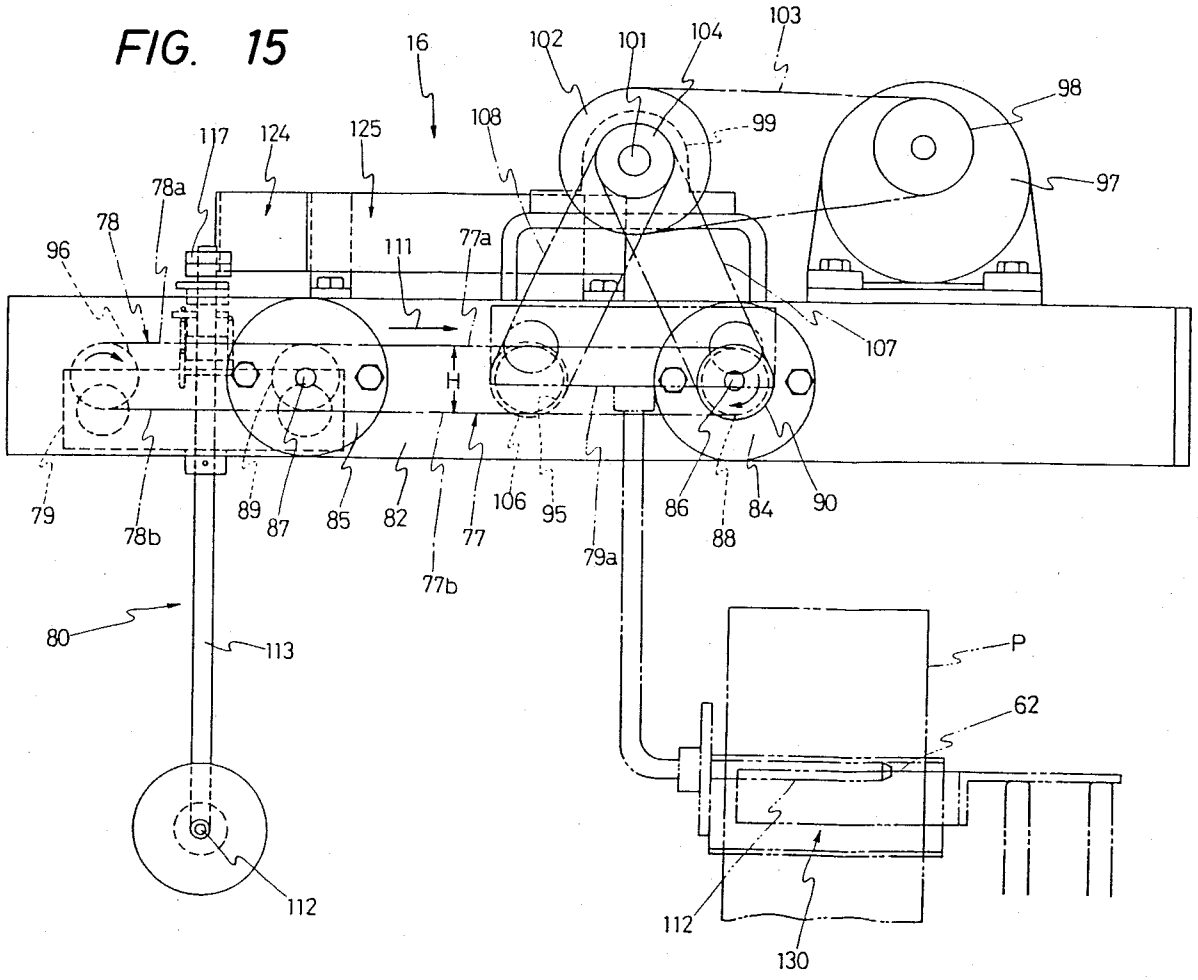
FIG. 15 shows a side view of a first package transfer mechanism provided on the stock truck.
Figure 16:
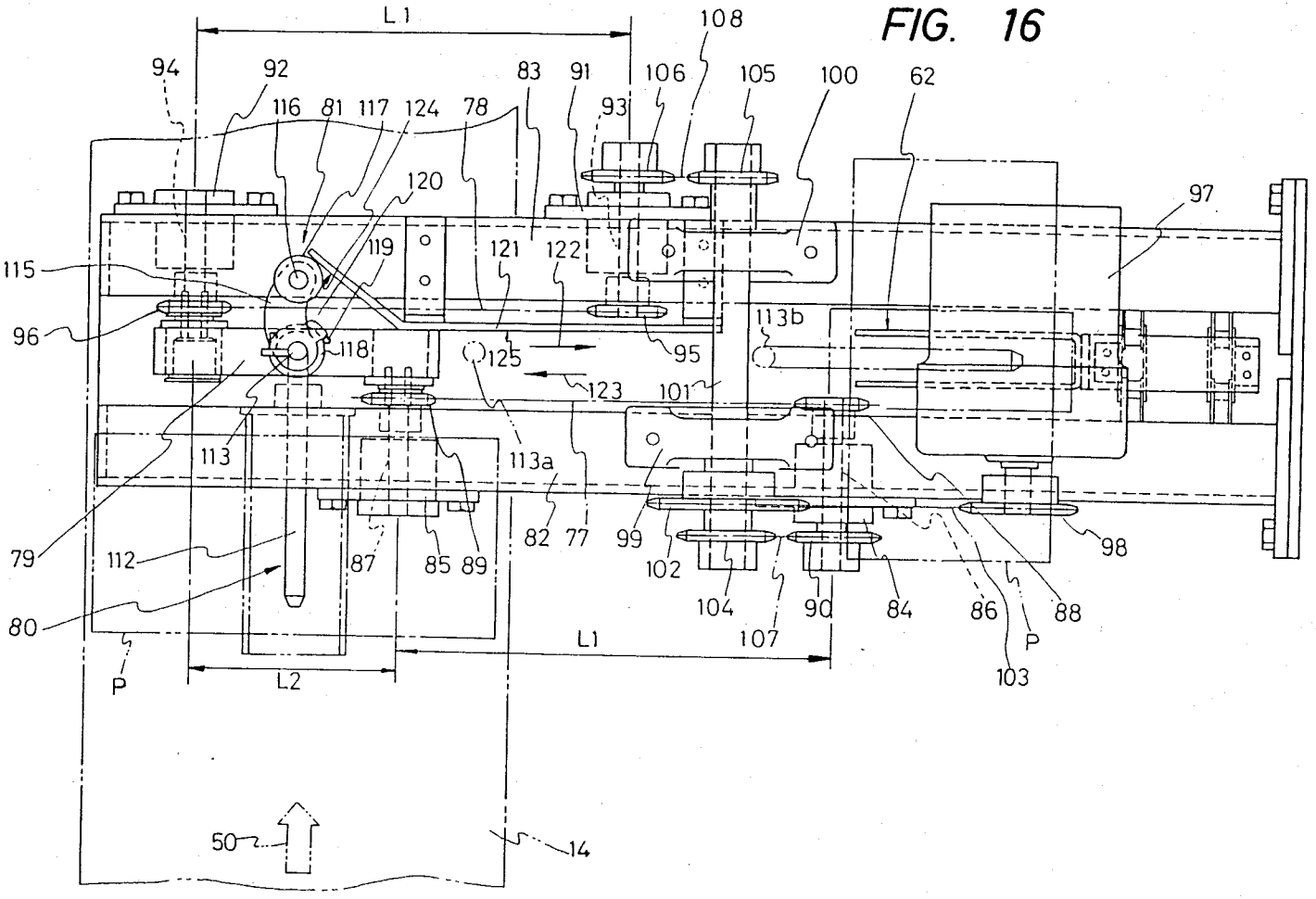
FIG. 16 shows a plan view of the same.

In FIGS. 15 and 16, the transfer mechanism 16 is constituted of a pair of endless circulatory chains 77, 78, a block 79 fixed to the chains 77, 78, a hook 80 penetrating vertically through the block 79 and capable of being rotated, and a cam mechanism 81 for rotating the hook 80 through a fixed angle.

Figure 17:
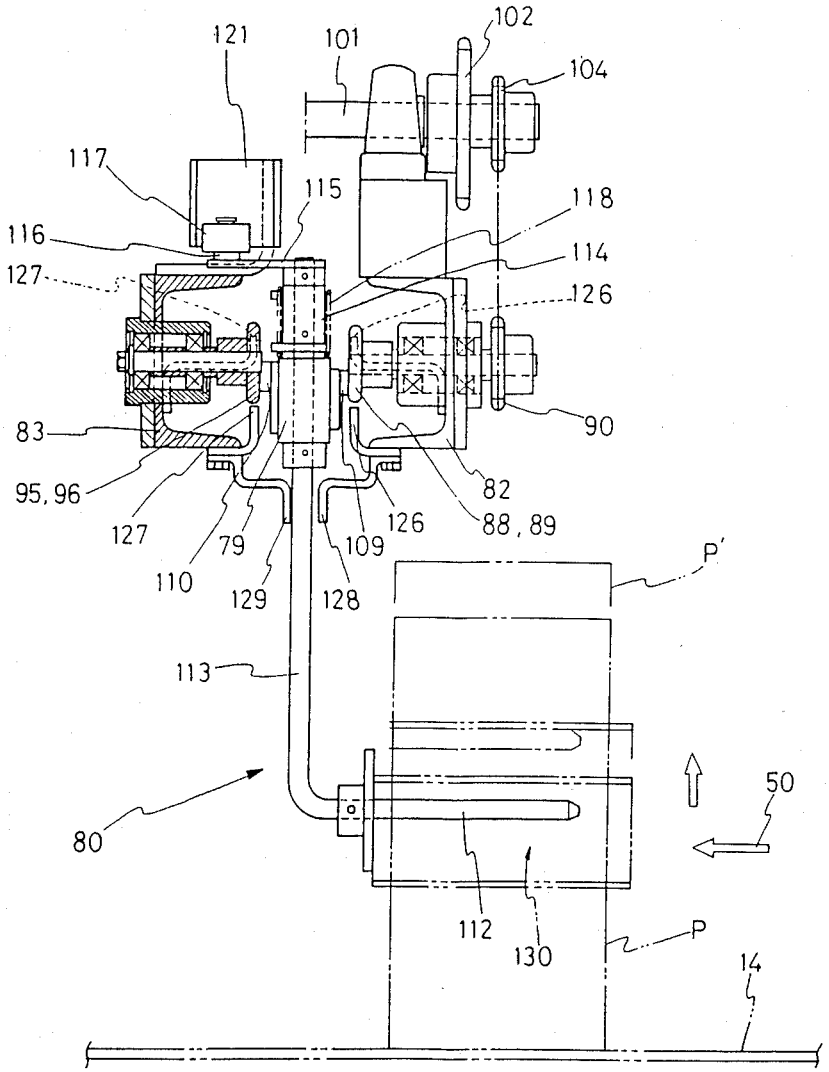
FIG. 17 shows a front view of the same.

As shown in FIGS. 16 and 17, a pair of angle frames 82, 83 are projected from the frame of the stock truck in a direction orthogonal to the feeding direction of the package feeding conveyor 14 shown in FIG. 1. Between the frames 82, 83 is provided a gap as a passage for a package transfer hook.

Bearings 84, 85 are fixed to one of the frames 82, sprockets 88, 89 are fixed to shafts 86, 87 supported by the bearings 84, 85, respectively, and a sprocket 90 connected to a drive source is fixed to the other end of one of the shafts 86. An endless roller chain 77 is fitted between the sprockets 88, 89.

Further, bearings 91, 92 are similarly fixed to the other frame 83, shafts 93, 94 are supported by the bearings 91, 92, and a roller chain 78 is fitted between sprockets 95, 96 fixed respectively to the shafts 93, 94. The spacing L1 between the sprockets 88, 89 is equal to the spacing L1 between the sprockets 95, 96, and the two pairs of sprockets are staggered from each other by a distance L2 in the longitudinal direction of the frames. In FIG. 16, a chain 103 is fitted between a sprocket 98 on a motor 97 provided on the frames 82, 83 and a sprocket 102 provided at an end part of a shaft 101 supported by bearings 99, 100 fixed on the frames 82, 83. Further, chains 107, 108 are fitted between sprockets 104, 105 provided at ends of the shaft 101 and the sprockets 90, 106 so that all the sprockets are rotated in the same direction.

In addition, as shown in FIGS. 16 and 17, side faces of the block 79 supporting the hook 80 are connected to link plates of the roller chains 77, 78, that is, a side face of a front part of the block 79 is connected to the chain 77 by a metal fixture 109, and the other side face of a rear part of the block 79 is connected to the chain 78 by a metal fixture 110. Therefore, the block 79 is brought into parallel motion by the synchronous circulatory motion of the chains 77, 78. Namely, the block 79 located at the broken-line position in FIG. 15 can be moved to the two-dotted line position 79*a* by the movement of the chains 77, 78 in the direction of arrow 111 and then be returned to the broken-line position by the movement of the chains; during this process, the block 79 is vertically displaced by the level difference H between upper circulatory paths 77*a*, 78*a* and lower circulatory paths 77*b*, 78*b* of the chains 77, 78 and is reciprocated along the frames 82, 83 by a distance equal to the spacing L1 between the sprockets 88, 89. By this motion, the hook 80 supported by the block 79 receives the package P located on the conveyor 14 and transfers the package to the package support member 62 located at the abovementioned package supply position A of the stock truck.

The hook 80 consists of a horizontal hook part 112 for supporting a package and a vertical shaft 113. The shaft 113 penetrates through the block 79. A bush 114 and a lever 115 integral with the bush 114 are fixed to the shaft part protruding upward from the block 79, and a cam follower 117 is rotatably supported on a vertical shaft 116 at an end part of the lever 115. Further, a spring 118 for energizing the lever 115 and the shaft 113 integral with the lever 115 clockwise around the shaft 113 in FIG. 16 is fitted over the periphery of the bush 114. Numeral 119 denotes a pin projected on the block 79. A contact piece 120 on the bush 114 side comes into contact with the pin 119, thereby positioning the shaft 113, and hence the hook part 112.

Further, a cam plate 121 which is contacted by the cam follower 117 to swivel the hook 112 is fixed on the frame 83 along the moving direction of the block 79. The cam plate 121 comprises a slant surface 124 slanted against the moving directions 122, 123 of the block 79, and a parallel surface 125 parallel with the directions 122, 123. By the contact of the slant surface 124 and the cam follower 117, the hook 112 is swiveled by 90° in this case. Namely, the conversion of direction between the receiving direction opposite to the feeding direction 50 of the package P on the conveyor 14 and the direction 122 for fitting the package to the support member at the stock part of the truck is performed mechanically by the cam mechanism 81.

In FIG. 17, numerals 126, 127 denote guide members for preventing the chains 77, 78 from sagging, whereby two upper and lower positions of the block 79 are securely maintained. Numerals 128, 129 denote a pair of hook guides which extend in the rotatorily moving direction of the chains, are so disposed as to clamp a shaft part 113 from both sides thereof, and prevent the hook 80 from vibrating in a transverse direction, namely, in a direction perpendicular to the rotatorily moving direction of the chains 77, 78. The hook guides 128, 129 cooperate with the chain guides 126, 127 in positioning the hook 80 in the vertical and transverse directions, so that it is possible to prevent misreceiving of the packages or missupply of packages to the stock part.

Accordingly, the center hole 130 of the package P fed in the direction of arrow 50 on the feeding conveyor 14 shown in FIG. 17 progresses to the hook part 112 standing by with the hook tip directed upward of the conveyor, and when the arrival of the package is detected by photoelectric tube sensor (not shown) or the like, the motor 97 shown in FIG. 15 is driven, whereby the pair of chains 77, 78 are rotatorily moved in the direction of arrow 111. As the chains are driven, the block 79 located at the stand-by position is first moved 180° around the sprockets 89, 96, whereby it is moved from the lower position to the upper position, also the package P supported by the hook 112 in FIG. 17 is moved to the upper position P' and is separated from the conveyor 14. The block 79 is moved further in the direction of arrow 122 in FIG. 16, whereby the hook 112 is moved toward the support member 62 at the stock part while being swiveled 90° by the action of the cam follower 117 and the cam surface 124. Namely, conversion of direction of the hook 112 is completed at the shaft position indicated by a two-dotted line 113*a* in FIG. 16, and when the hook 112 is moved forward to the shaft position 113*b*, the fitting of the package P to the support member 62 is completed. Further, as the block 79 is moved downward through the sprockets 88, 95, the package 62 on the hook 112 in FIG. 15 is supported on the support member 62, and the hook 112 is moved backward to be separated from the center hole 130. Further, when the block 79 is moved in the direction of arrow 123 in FIG. 16 and the shaft 113 passes through the position 113*a*, the cam surface 124 and the cam follower 117 is energized by a spring function so as to swivel the hook 112 90° in the reverse direction, thereby setting the hook 112 into the initial stand-by condition.

As described above, one package is supplied to a support member by one reciprocation of the hook 79.

(vi) Second package transfer mechanism

The second package transfer mechanism 17 provided on the stock truck is provided at the package stock part 15 in FIGS. 8 and 9, and comprises pushers 131, 132 for pushing out the rear end face of the package P and a driving mechanism 133 for the pushers. This is described in detail referring to FIGS. 18 to 20. Namely, the pushers 131, 132 extending between a predetermined number of packages P1 to P6 on the stock truck are so disposed as to be located on the side of the end faces of the packages and on both sides of the chain 61, are brought into synchronous parallel motion by a hydraulic cylinder 134 and link mechanisms 135, 136 thereby simultaneously transferring a plurality of packages P1 to P6 to the creel pegs by pushing out the packages.

Figure 18:
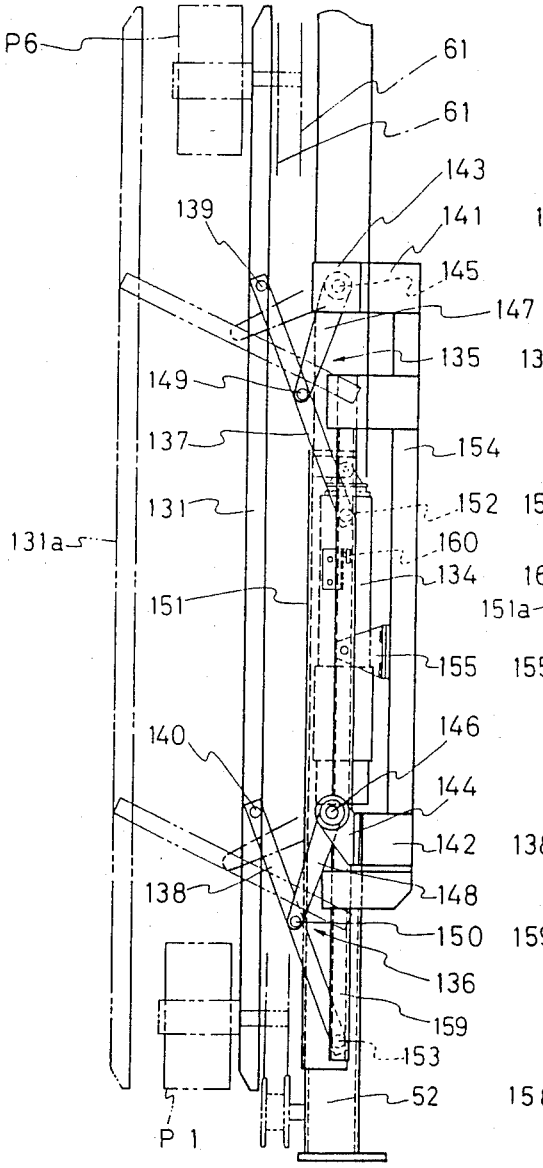
FIG. 18 shows a side view of a second package transfer mechanism provided on the stock truck for transferring the packages on the truck to the pegs of the creels.
Figure 19:
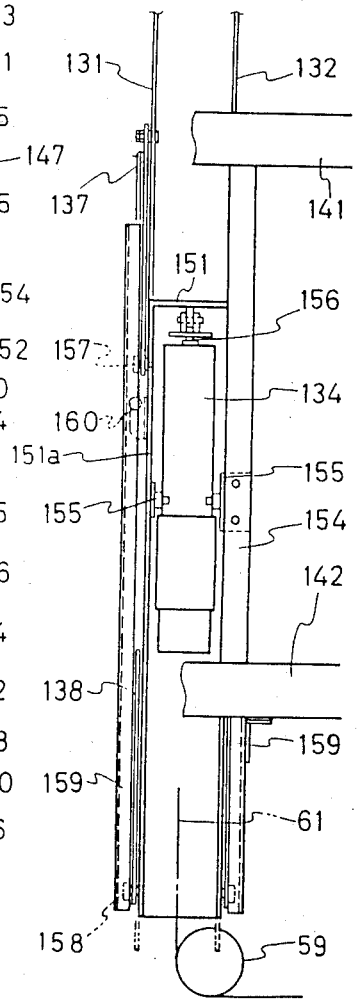
FIG. 19 shows a rear view of the same.

One of the pushers 131 is explained referring to FIGS. 18 and 19, and the explanation applies also to the other pusher 132. The pusher 131 is connected to links 137, 138 at two positions by shafts 139, 140, and an intermediate parts of the links 137, 138 are connected by shafts 149, 150 to levers 147, 148 which are swivelably supported through shafts 145, 146 on bearings 143, 144 fixed to the frames 141, 142 of the truck. Further, end parts of the links 137, 138 are pivotally supported 152, 153 on one side surface 151*a* of a lift body 151 which has a U-shaped horizontal cross section and is moved up and down by the hydraulic cylinder 134. The lift body 151 is connected to a piston rod 156 of the hydraulic cylinder 134 supported through brackets 155, 156 on a support column 154 fixed to the frame 52, and is moved up and down through a fixed stroke accompanying the extension and retraction of the piston rod 156.

Figure 20:
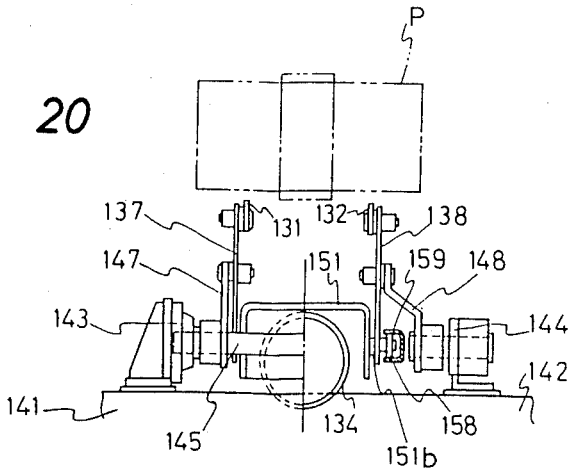
FIG. 20 shows a front view of the same, the left half showing a one-side plan view of an upper bearing part shown in FIG. 18, and the right half showing a one-side plan view of a lower bearing part shown in FIG. 18.

Further, guide rollers 157, 158 are supported on shafts 152, 153 provided at end parts of the links 137, 138, and the rollers 157, 158 and a guide roller 160 provided at an intermediate part of the lift body 151 are engaged with a guide rail 159 fixed to a side face of the frame 52; the end parts 152, 153 of the links 137, 138 are moved rectilinearly on the guide rail 159. FIG. 20 is a stepped cross-sectional view, the left half thereof shows a plan view of the part of the upper bearing 143 shown in FIG. 18, while the right half thereof shows a horizontal cross-sectional view of the part of the lower bearing 144 shown in FIG. 18. Namely, for instance, one end of the link 138 is connected with the pusher 132, while the other end is connected to one side face 151*b* of the lift body 151, and the guide roller 158 is supported through a shaft and is engaged to the guide rail 159 fixed to the frame.

The operation of supplying packages to creels by the device described above will be explained as follows.

(I) Supply of packages to stock truck

In FIG. 4, the original of the hook 24 in the package direction converter 22 is the two-dotted line position 24*a*, and the hook 24 stands by in this position. The packages P0 fed in the direction of arrow 46 on the first conveyor 11 is stopped at the position of the sensor S1. Based on a package direction signal from the sensor S1 and a package absence signal from the sensor S2, the hook 24*a* in the original position is swiveled to the solid-line position. Namely, swiveling of the hook 24 is stopped at the position where the limit switch 44 on one side is turned ON, and the hydraulic cylinder 27 shown in FIG. 7 is operated to lower the hook 24 to a package receiving position. In this condition, the first conveyor 11 is again circulatorily moved, whereby the package P0 in the position S1 is further fed in the direction of arrow 46, and the center hole 37 of the package progresses to the hook 24*c*. When the package reaches a position where it makes contact with the flange part 38 of the hook 24, the sensor S2 shown in FIG. 4 detects the package P1, and movement of the second conveyor 14 is stopped by the detection signal from the sensor S2. The first conveyor 11 continues circulatory movement until the next package reaches the position of the sensor S1. In response to the turning-ON of the sensor S2, the hook-lifting cylinder 27 and the swiveling cylinder 41 of the converter 22 are driven to transfer the package on the hook 24 onto the second conveyor 14. Since the second conveyor 14 is already in circulatory motion, the package is immediately released from the hook 24 and is moved along the conveyor 14 in the direction of arrow 50 in FIG. 4.

The package fed on the second conveyor 14 passes through the position of the sensor S3; then, when a sensor S6 for detecting that the hook 112 of the first package transfer mechanism 16 is in the package-receiving position indicated by the two-dotted line in FIG. 4 is turned ON and both a sensor S5 provided at the receiving position and a package detecting sensor S4 provided on the upstream side of the receiving position detect the absence of package, the package passes through the position of the sensor S3, and passes further through the position of the sensor S4 to progress to the hook 112 standing by.

In this case, the hook 24*a* in the two-dotted line position is swiveled again to the solid-line position 24 and receives the next package, under the conditions that the sensor S3 detects the passage of the package, the sensor S1 on the side of the first conveyor 11 detects the presence of the package and the sensor S2 detects the absence of package.

On the other hand, when the hook 112 of the first package transfer mechanism 16 receives the package P5, the sensor S5 is turned ON, and the motor 97 shown in FIGS. 15 and 16 of the transfer mechanism 16 is driven. Accordingly, by the abovementioned operation of the first transfer mechanism, the package P5 on the second conveyor 14 is moved toward the package support member 62 standing by at a fixed position on the stock truck.

In FIG. 4, the package P4 fed onto the second conveyor 14 during the operation of the hook 112 for transferring the package, namely, during when the sensor S6 is detecting the absence of the hook is stopped by the stop of the conveyor 14 at the position of the sensor S4, and waits for the next transfer operation.

When the package is supplied to the support member 62 in the package receiving position of the stock part of the truck shown in FIG. 8 by the first transfer mechanism, the motor 68 for rotatorily moving the chain 61 shown in FIGS. 8 and 9 is driven based on AND of a signal from a package-detecting sensor S7 provided at the receiving position and a hook return detection signal from the sensor S6 shown in FIG. 4, whereby the chain 61 is rotatorily moved in the direction of arrow 161, and the package P8 in the receiving position is moved by one pitch to the position P7. Namely, by the rotation of the motor 68, the upper large sprocket 58 is rotated through the chain 61, and when the sensor S8 detects the notch 75*b* of the disk 73 for normal pitch shown in FIGS. 13 and 14, the motor is stopped under the condition wherein the sprocket 58 is rotated 90°. The circuitry is so constructed that the signal from a half-pitch detecting sensor S9 is blocked at this moment. Namely, in FIG. 13, at the time of reception of the package, the sensor S8 detects the notch 65*a*, and when the notch 75*b* is brought to the position of the sensor S8 by the rotation of the sprocket 58 in the direction of arrow 161, the motor 68 is stopped by the signal from the sensor S8. In this manner, the packages are sequentially transferred to the package support members 62 on the chain 61.

In FIG. 8, when a sensor S10 provided on the lower side of the truck detects the package P1, the support members in the region ranging from the receiving position A to the position of the sensor S10 have been loaded with the packages P1 to P8, so that the packages corresponding at least to one row of the creels have been transferred onto the stock truck.

(II) Supply of packages from stock truck to creels

The method of supplying the packages from the stock truck to the creels will be explained with reference to two patterns. In the first method, the packages are supplied to the stock truck at the original position, then the stock truck loaded fully with the packages is moved to a predetermined creel position, and the packages are supplied to the creel. In the second method, the stock truck is previously moved to the position of the creel to be supplied with the packages, the packages are supplied from the conveyor to the stock truck at the position, and when a predetermined number of packages are supplied to the stock truck, the truck directly starts supplying the packages to the creel without being moved.

The first method will be explained referring to FIGS. 8 and 23.

Figure 21:
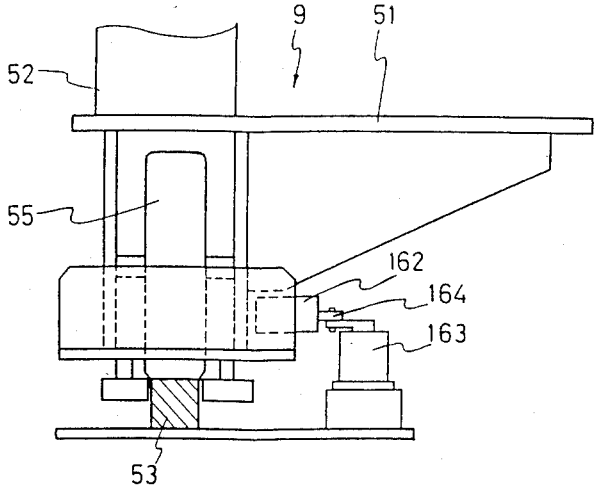
FIG. 21 is a side view showing an example of a device for positioning the stock truck relative to a row of creels.
Figure 22:
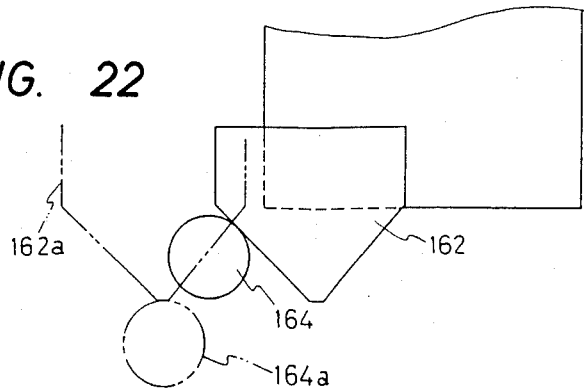
FIG. 22 is a plan view showing the relative actions of a dot provided on the truck side of the same device and an actuator for a limit switch provided on the ground side.
Figure 23:
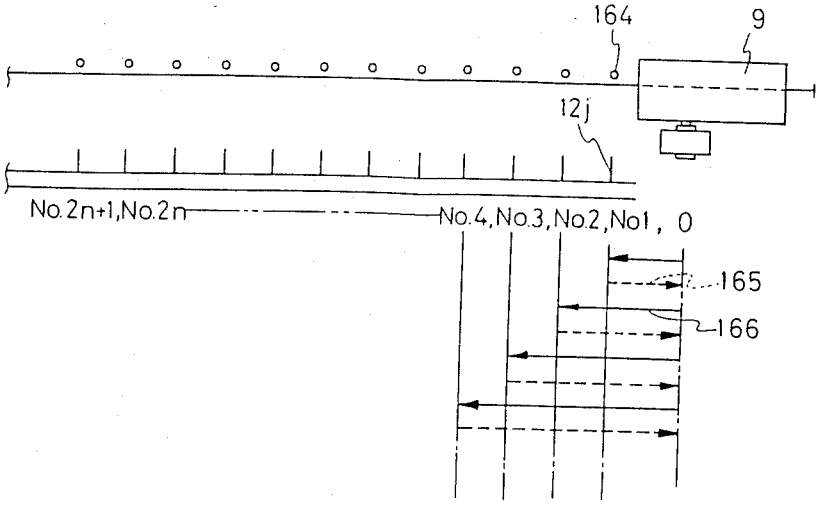
FIG. 23 is an explanatory view illustrating a first method of supplying the packages to the warper creels by the device according to the invention.

In FIG. 23, at the original position 0 the stock truck 9 is supplied with the packages from the package feeding conveyor to the support members on the chain by the first package transfer mechanism; the packages P1 to P8 are supplied, in FIG. 8. When the chain 61 is rotatorily moved in response to the turning-ON of the sensor S7, the sensor S10 provided beneath the lowermost package P1 is turned ON to indicate that a predetermined number of packages P1 to P8 have been supplied onto the truck 9, then the truck 9 starts moving to the row No. 1 of the creels in FIG. 23, and is stopped there. Namely, a dog 162 provided on the truck shown in FIGS. 21 and 22 is engaged to an actuator 164 for a limit switch 163 disposed at a floor position corresponding to each creel row, whereby the truck is decelerated and stopped. The truck is stopped at the engaging position of the dog 162*a* and the actuator 164*a* in FIG. 22. At this stop, an error is about ±1 mm.

While the truck 9 is moved from the original position 0 to the position of the creel row No. 1, the packages P1 to P8 shown in FIG. 8 are moved to a half-pitch lower position, and are stopped there. Namely, the packages are once stopped at the time when the notch 76*a* of the disk 74 shown in FIGS. 13 and 14 reaches the position of the sensor S9.

Where the peg arrangement on the creel No. 1 is the same as that on the $(2n+1)$th creel 12*j*, the packages in the half-pitch shifted positions on the truck conform to the peg positions on the creel No. 1; therefore, after stopping the truck, the second transfer mechanism 17 in FIGS. 18 and 19 operates, whereby the pushers 131, 132 transfer the packages P1 to P6 on the front side thereof simultaneously to the pegs 13*a* to 13*f* on the creel 12*j*.

When the transfer of the packages to the creel No. 1 is completed, the stock truck 9 is again returned to the original position 0 as indicated by a broken-line arrow 165 in FIG. 23. At this time, the package support member 62 on the truck is in a half-pitch staggered positions; therefore, the chain is rotatorily moved further by a half pitch, whereby the next support member 62' is brought to the package receiving position A in FIG. 8. In this condition, the supply of package to the truck in the original position 0 is restarted, and when a predetermined number of packages are transferred in the same manner as described above, the truck starts moving toward the position of the next creel No. 2 in the direction of a solid-line arrow 166 in FIG. 23.

During the movement, the packages on the truck are located at one half pitch shifted positions, and the peg positions of the creel No. 2 are staggered by one half pitch from those on the creel No. 1; therefore, the chain on the truck arriving at the creel No. 2 is rotatorily moved further by one half pitch, whereby the packages P1 to P8 conform to the peg positions on the $(2n)$th creel 12*j*, as shown in FIG. 2. Namely, the lowermost package P1 takes the one pitch shifted position P11. Thereafter, the packages P1 to P6 on the truck are simultaneously transferred to the No. 2 creel.

In this manner, as shown in FIG. 23, the truck is reciprocated between each creel row No. 1, No. 2 . . . and the original position 0, thereby supplying the packages to the creels. Accordingly, in this case, the second package feeding conveyor 14 shown in FIGS. 2 and 4 may not be laid over the entire region of the creels, and it suffices to extend the conveyor to the original position of the truck.

Next, the second method will be explained. In this case, the stock truck is supplied with packages from a conveyor in the state of being previously positioned at a predetermined creel position. Namely, in FIG. 24, packages and supplied to the stock part of the truck 9 located at the position of the No. 1 creel. When the packages P1 to P8 are supplied as shown in FIG. 25*a*, the lowermost sensor S10 detects the package P1 as the chain is rotatorily moved, whereby the supply of a predetermined number of packages onto the chain is confirmed, the movement of and the chain 61 is stopped in the condition wherein the packages P1 to P8 are shifted one half pitch 1/2 downward, as indicated in FIG. 25*b*. In the same manner as above, if the peg positions on the No. 1 creel are one half pitch upper than those of the $(2n)$th creel in the same manner as the creel of the $(2n+1)$th row in FIG. 2, the packages are immediately transferred onto the creel from the stock truck in the condition shown in FIG. 25*b*. Namely, the hydraulic cylinder 134 of the second transfer mechanism 17 shown in FIG. 18 is driven, whereby the pushers 131, 132 are moved from the solid-line positions to the two-dotted line positions 141*a*, so that the packages P1 to P6 in FIG. 25*b* which are located on the front side of the pushers are simultaneously transferred to the pegs 13*a* to 13*f* on one row on the creel 12*j*.

Figure 24:
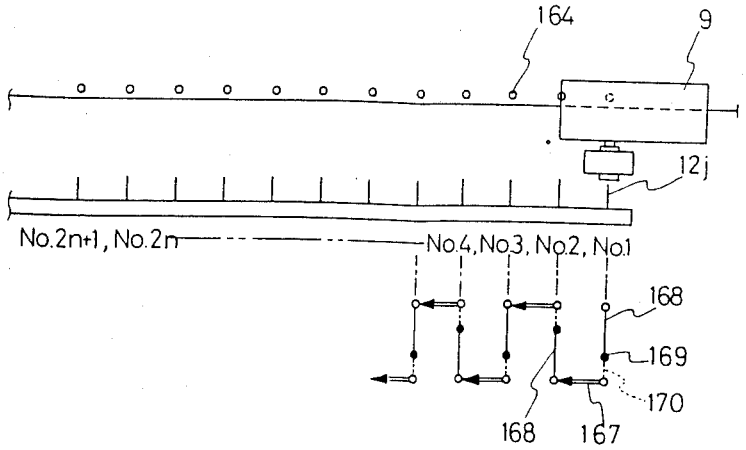
FIG. 24 is an explanatory view illustrating a second method of supplying the packages by the device according to the invention.
Figures 25A, 25B, 25C, 25D:
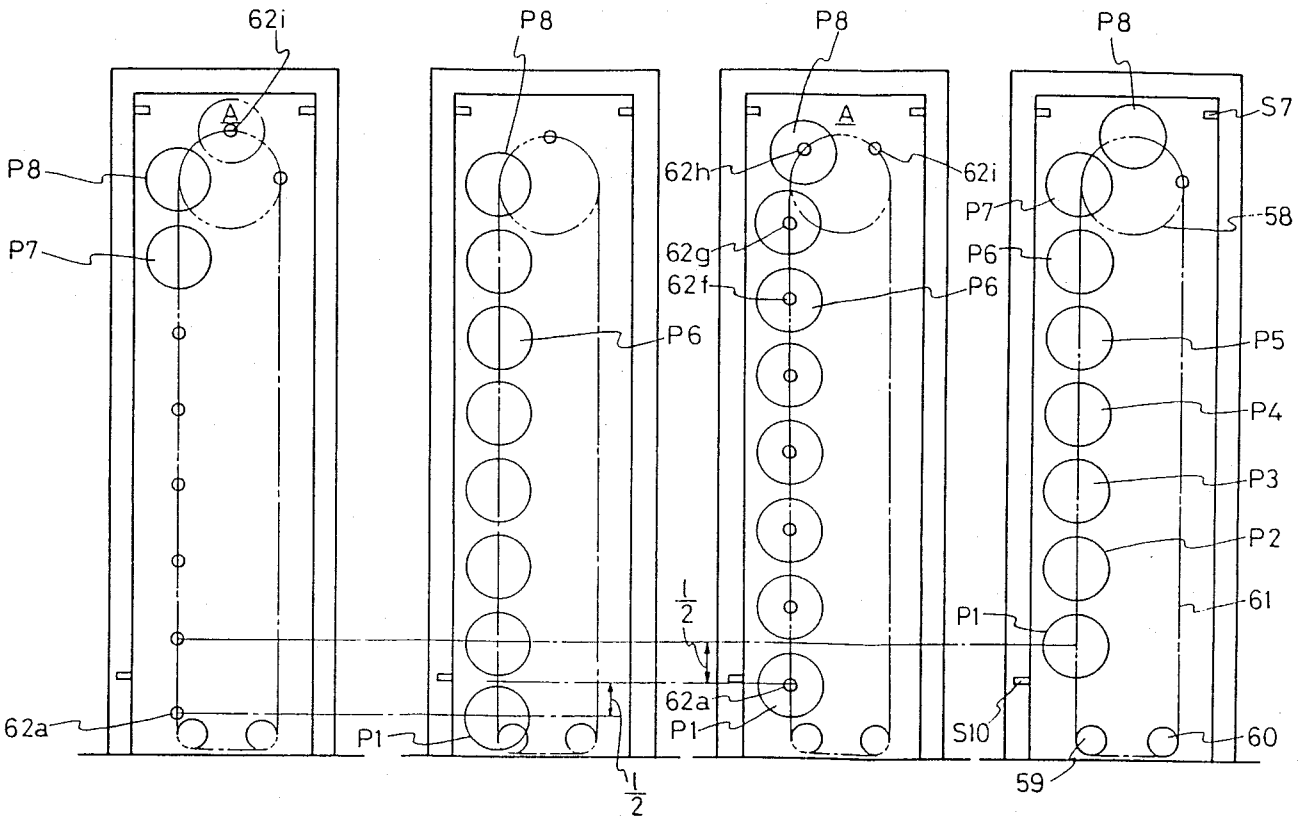
FIGS. 25*a*, 25*b*, 25*c* and 25*d* are plan views illustrating the control of the package position on the stock truck in supplying the packages to the warper creels shown in FIG. 2.

When the pushers 131, 132 are returned to their initial positions, the truck 9 is moved in the direction of arrow 167 in FIG. 24, from the position of the No. 1 creel to the position of the No. 2 creel, and the supply of the packages from the conveyor to the truck is restarted. At this moment, the support members 62*a* to 62*f* in FIG. 25*b* are vacant, and the support members 62*g*, 62*h* are loaded with the package. Therefore, after the chain 61 is rotatorily moved one half pitch so that a vacant support member 62*i* reaches the receiving position A, namely, in the condition shown in FIG. 25*d*, the supply of packages from the conveyor is restarted.

Figure 13:
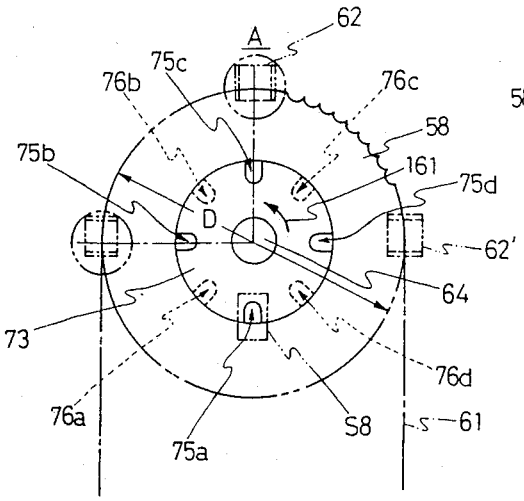
FIG. 13 shows a rear view of an upper sprocket of the stock truck, the package support member and a rotational angle detector for the sprocket.

When 6 packages are newly supplied, the condition of FIG. 25*a* is again established, then the sensor (S10) detects the package to indicate full loading, resulting in the position shown in FIG. 25*b*, as above. Then, since the positions of the pegs 13*a'* to 13*f'* on the No. 2 creel are one half pitch lower than those of the pegs on the No. 1 creel in the same manner as the $(2n)$th creel in FIG. 2, the chain 61 is rotatorily moved further by one half pitch 1/2 from the condition of FIG. 25*b*, namely, the notch 75*b* of the disk 73 shown in FIGS. 13 and 14 is brought to the position of the sensor S8, upon which the movement of the chain is stopped. Accordingly, the packages P1 to P8 take the one half pitch lowered positions shown in FIG. 25*c*, where they face the pegs 13*a'* to 13*f'* of the $(2n)$th creel shown in FIG. 2. In this condition, the 6 packages P1 to P6 are simultaneously transferred to the pegs on the creel by the pushers 131, 132 in the same manner as above.

After the packages are transferred to the No. 2 creel, the stock truck is in the condition of FIG. 25*d*. Therefore, when the truck 9 is moved to the position of the next, No. 3 creel, the next vacant support member 62*i* is already located in the receiving position, and the supply of new packages from the conveyor to the truck is immediately restarted.

Namely, in FIG. 24, a solid line 168 indicates the operation of supplying a package to the truck 9, a solid circle 169 indicates a fully loaded condition, a broken line 170 indicates the transfer of the package from the truck to the creel 12, and a double line 167 indicates the movement of the truck to the position of the next creel.

By the abovementioned second method, the packages can be supplied to all creels by simply intermittently moving the stock truck 9 in one direction along the row of the creels, so that it is possible to shorten the working time as compared to that in the first method.

In either of the first and second supply methods shown in FIGS. 23 and 24, the packages fed by the conveyor from the package storage area are once transferred onto the truck in a number which corresponds at least to one row of the creels, and then the packages are simultaneously transferred to the pegs of one row of the creels, so that the working time is markedly shortened, as compared to the conventional case of manual operation.

Although the warper creels in the example described above are in a staggered arrangement wherein the peg positions on a creel row are one half pitch staggered from those on the adjacent creel row, the supply of the packages from the stock truck 9 to the creels is performed with a more simpler control where the pegs are at the same levels for every creel row. Namely, the rotatory motion of the chain fitted with the package support members on the truck can be performed at a pitch equal to the peg pitch on the creels, so that the step of moving the chain by one half pitch at a time in the abovementioned example can be omitted.

Further, as shown in FIGS. 1 and 3, in the type in which the creel frame is rotatorily moved, supply of packages to the inside creel row *6b* is conducted during a warping operation, and when the payout of yarns from the packages on the outside creel row *6a* is finished, the creel frame is rotatorily moved as a whole, whereby the inside creel row and the outside creel row are replaced by each other, the creel row supporting new packages is located on the outside, and the warping operation is restarted.

As has been described above, according to the present invention, the supply of packages to the pegs of an extremely large number of warper creels can be performed efficiently. In particular, heavy packages of 2 to 3 kg can be smoothly fed and supplied. In addition, the working time can be markedly reduced, and it is possible to avoid the danger to the worker in supplying the packages to a high position of the creels.

What is claimed is:

1. A device for supplying packages to warper creels having a multiplicity of package support pegs orderly arranged thereon, comprising an elongate package stock truck moved in the row direction of said warper creels having a plurality of spaced package support members, a package feeding conveyor for feeding said packages to the position of said stock truck, a first package transfer mechanism for transferring said packages on said conveyor onto the respective support member of said stock truck, and a second package transfer mechanism for simultaneously transferring a group of said packages on said stock truck to each of said pegs of said warper creels.

2. A device for supplying packages to warper creels having a multiplicity of package support pegs orderly arranged thereon, comprising a package stock truck moved in the row direction of said warper creels, a package feeding conveyor for feeding said packages to the position of said stock truck, a first package transfer mechanism for transferring said packages on said conveyor onto said stock truck, and a second package transfer mechanism for transferring said packages on said stock truck to each of said pegs of said warper creels, said package stock truck being provided with a package stock part in which package support members are fixed, at the same pitch as that of the pegs of the creels, to chains fitted in an endless form, the first package transfer mechanism being positioned at an upper part of the stock truck, and the second package transfer mechanism positioned for transferring the packages stocked at the package stock part in a number corresponding to the number of pegs in at least one creel row.

3. A device as claimed in claim 2, wherein said package stock part comprises a pair of large sprockets fixed to a shaft on an upper frame of the truck, pairs of small sprockets fixed respectively to shafts on a lower frame, a pair of endless chains fitted to a pair of the large sprocket and the small sprockets, the package support members being fixed to the chains and a driving means for rotating the sprockets intermittently.

4. A device as claimed in claim 3, wherein said intermittent rotation of the sprockets is controlled by rotational angle detecting disks and sensors which are fixed to a shaft for the large sprocket, said disks being provided with notches angularly spaced by a certain angle from each other.

5. A device as claimed in claim 4, wherein said first package transfer mechanism is constituted of a pair of endless circulatory chains, a block fixed to the chains, a hook penetrating vertically through the block and capable of being rotated, and a cam mechanism for rotating the hook through a fixed angle, said block being brought into parallel motion by the synchronous circulatory motion of the chains so that the hook supported by the block receives the package located on the conveyor and transfer the package to the package support member located at a package supply position of the stock part.

6. A device as claimed in claim 5, wherein said hook consists of a horizontal hook part for supporting a package and a vertical shaft which penetrates through the block and to which a lever is fixed, and said cam mechanism includes a cam follower rotatably supported on a vertical shaft of the lever and a cam plate which is contacted by the cam follower and comprises a slant surface for swiveling the hook and a parallel surface for receiving the package on the hook from the package feeding conveyor.

7. A device as claimed in claim 2, wherein said second package transfer mechanism comprises a pusher extending between a predetermined number of packages on the stock truck for pushing out the rear end face of the package and a driving mechanism for the pushers.

8. A device as claimed in claim 7, wherein said driving mechanism comprises link mechanisms connected to the pusher and a hydraulic cylinder for moving the links to bring the pusher into parallel motion and thereby simultaneous transferring a plurality of packages to the creel pegs by pushing out the packages.

9. A device for supplying packages to warper creels having a multiplicity of package support pegs orderly arranged thereon, comprising a package stock truck moved in the row direction of said warper creels, a package feeding conveyor for feeding said packages to the position of said stock truck, a first package transfer mechanism for transferring said packages on said conveyor onto said stock truck, and a second package transfer mechanism for transferring said packages on said stock truck to each of said pegs of said warper creels, wherein said package feeding conveyor comprises a first conveyor extending from a package storage area while connecting the ends of a pair of creels including creels on the side on which the yarns drawn out from the packages on the pegs run to a warper drum and other creels on the side on which the package stock truck is moved, a second conveyor intersecting the first conveyor at an angle and provided above the creels along the row direction of the creels, and a package direction converter which is provided between the first and second conveyors, said package direction converter comprising a package holding hook moved vertically and swiveled through a fixed angle and a driving part having a hydraulic cylinder disposed vertically on a fixed frame and a swiveling driving box for the hook suspended from the lower end of a piston rod of the cylinder.

10. A device as claimed in claim 9, wherein said driving box includes a shaft supported by the driving box which is bent at a part thereof to form the holding hook, a pinion fixed to an upright part of the shaft, a rack provided with teeth engaging with the pinion, and a rodless cylinder to which the rack is fixed, so that by the movement of the rack fixed to the cylinder, the shaft is rotated and the package holding hook is swiveled with the shaft as a center.

* * * * *